US005611142A

United States Patent [19]

Kies

[11] Patent Number: 5,611,142

[45] Date of Patent: Mar. 18, 1997

[54] METHOD OF MAKING ELECTRICAL CONNECTORS

[75] Inventor: Antonius M. Kies, Oisterwijk, Netherlands

[73] Assignee: Erico International Corporation, Solon, Ohio

[21] Appl. No.: 467,185

[22] Filed: Jun. 6, 1995

[51] Int. Cl.[6] ..... H01R 43/16

[52] U.S. Cl. ..... 29/874; 29/882; 29/33 M

[58] Field of Search ..... 29/874, 882, 33 M

[56] References Cited

U.S. PATENT DOCUMENTS

| | | | |
|---|---|---|---|
| 3,601,890 | 8/1971 | Pityo et al. | 29/874 |
| 4,836,006 | 6/1989 | Brown | 29/882 X |
| 5,031,305 | 7/1991 | Furrer et al. | 29/882 X |
| 5,077,892 | 1/1992 | Nugent | 29/874 |

*Primary Examiner*—Carl J. Arbes
*Attorney, Agent, or Firm*—Renner, Otto, Boisselle, Sklar

[57] ABSTRACT

Extruded conductive metal stock has a number of grooves along one long side of the sectional configuration of the stock which extend almost to the other long side. The grooves form parallel fingers. The stock is transversely cut to form machining stock blocks and the fingers become square posts projecting from a bar. The stock blocks may be cut between the posts to form smaller blocks with fewer fingers or posts. The blocks are then loaded on a machining center pallet with the fingers facing radially outwardly. The pallet is indexed through the machining center to form the square in section fingers into round posts, using a center flush hollow mill. The diameter of the mill and the spacing of the fingers is selected to avoid secondary milling. The posts are axially drilled to form a barrel wall and one or more set screw holes are drilled and tapped in the wall. If a flat pad pressure connector is formed, the posts are cut to form the pad prior to machining, and the axial drilling is omitted.

15 Claims, 2 Drawing Sheets

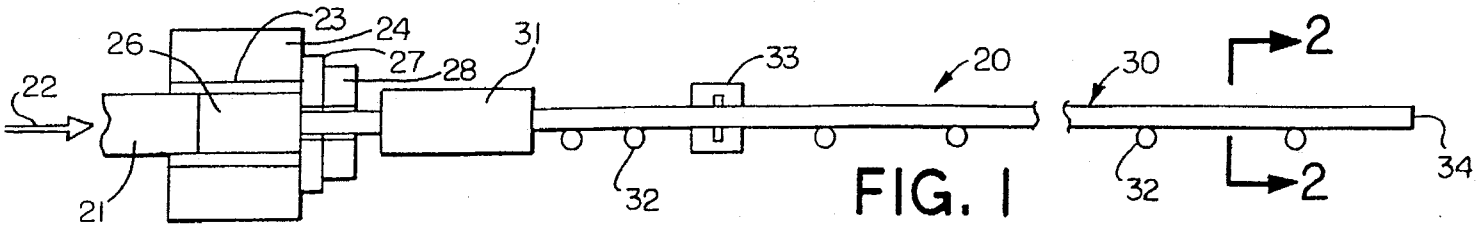
FIG. 1
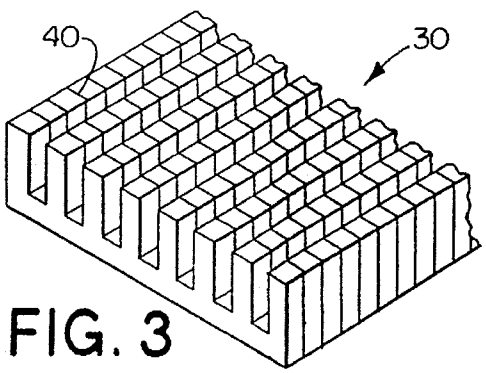
FIG. 3
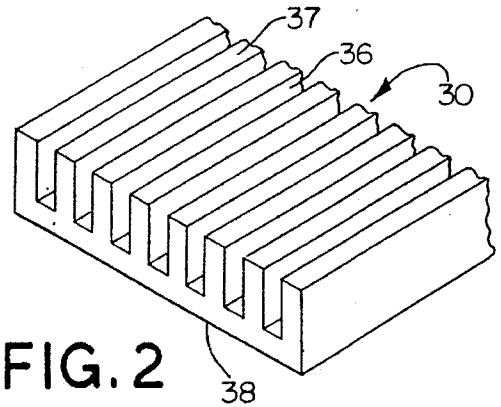
FIG. 2
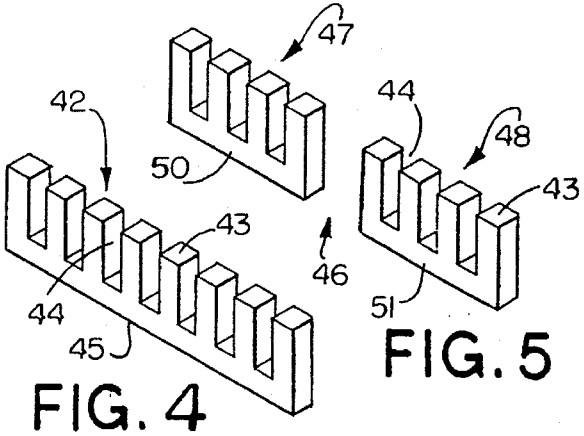
FIG. 5
FIG. 4
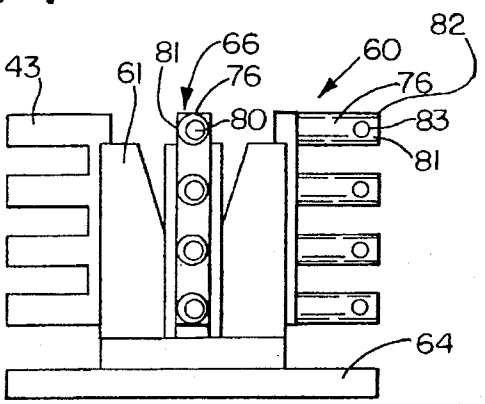
FIG. 8
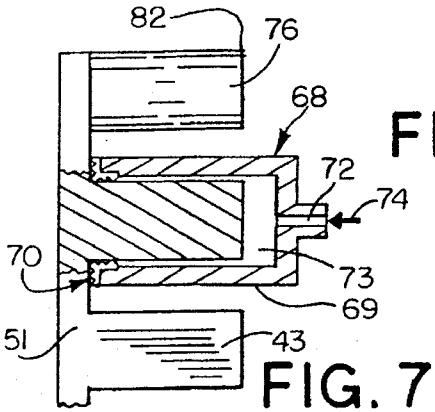
FIG. 7
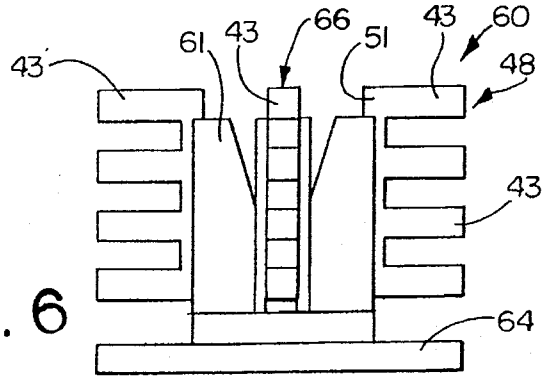
FIG. 6

METHOD OF MAKING ELECTRICAL CONNECTORS

DISCLOSURE

This invention relates generally as indicated to electrical connectors and a method of making such connectors, and more particularly to high ampacity underground bus type connectors widely used in utility distribution systems, and an extrusion-machining method of making such connectors.

BACKGROUND OF THE INVENTION

Underground and submersible junction bus connectors are widely used in utility distribution systems. Typical of such connectors are the connectors sold under the trademark ESP® by Eritech, Inc. of Aberdeen, N.C. under the model designations UC, HFS, RD, UCD, BRD, and UCB. Such connectors are commonly characterized by a rigid bar or bus from which projects a plurality of relatively closely spaced circular posts. The thickness of the bar or bus may typically be about one tenth or less the projection of the posts. The number of posts may vary from as few as two to as many as eight or more. Such submersible connectors are widely used in connections to transformers underground in electrical power distribution systems.

There are generally two types of such connectors. One employs hollow posts for each terminal or outlet and one or more set screws to clamp and secure the end of a conductor within each hollow post. Another type utilizes a flat pad on the end of an otherwise solid post. One or more compression fasteners secure a conductor lug to the flat pad. The flat pad may extend for approximately the outer two thirds of the post, and the outer end of the pad surface may include an alignment recess interfitting with the conductor lug to maintain lug and post alignment. With such connectors, high amperage connections can quickly be made.

Because of the complex configuration of the connectors which include a lot of non-parallel surfaces, they are typically made by fabrication with weldments or from aluminum alloy castings, all at considerable cost. One of the principal cost problems in casting is that separate molds or dies are required for each model of connector, and within the model for each number of terminals or outlets. Accordingly, the investment in molds and core molds, or dies alone is staggering.

Moreover, the castings have to be made in a job shop foundry or die casting shop which further raises the cost. While some large scale foundries or die casting shops can afford the environmental strictures now required, many smaller foundries or shops can not, and many have closed, requiring importation of castings and/or much higher costs. In addition to higher costs, uncertainty of supply is a problem with casting.

In addition to the economic and environmental problems, castings present some technical problems as well. The surface texture is rather rough which is not ideal for higher amperage electrical connections. They require a considerable amount of grinding or surface finishing after casting and this is usually a manual labor intensive operation. They still require tapping of holes for clamping or set screws, and the casting makes alignment and jigging problems more complex. Also, the physical properties and microstructure of castings can be less than desirable. For example, an extruded and machined part will have considerably higher mechanical strength, better conductivity, better appearance, and improved surface contact with the conductor.

The extrusion process, particularly hot extrusion, has been widely used to produce a variety of parallel surface shapes including some electrical connectors. Such connectors have relatively simple square, rectangular or other parallel face surface shapes, and secondary machining operations are generally limited to drilling and tapping in such parallel face surfaces. Examples of such extruded connectors are those sold under the trademark ESP® by Eritech, Inc. of Aberdeen, N.C., under the model designations UP, UPSO, UPM, UPT and UPL. Using the extrusion process to produce such relatively simply parts results in quality connections which are economical to produce.

It would, accordingly, be desirable to be able to produce the more complex connectors having a lot of non-parallel surfaces by an extrusion-machining process to produce both improved and lower cost connectors.

SUMMARY OF THE INVENTION

The present invention utilizes an extrusion-machining process to form complex round post electrical connectors. An extrusion process is used to form a rectangular-in-section conductive metallic extrudate having equally spaced slots along one long side extending almost to the opposite long side to form linear projections extending from the opposite long side. The metallic extrudate after cooling is cut to stock lengths for bundling and shipping for further processing and machining.

The stock lengths of the striated stock are then transversely cut normal to the extrusion axis to form generally rectangular finger blocks of conductive metal so that the slots in the stock form generally square posts projecting from the unslotted side of the rectangular finger block. The slots and the generally square posts formed by the extrusion and transverse cutting steps form the basic building block for the largest size of connector to be produced. For example, seven equally transversely spaced slots in the extrudate will produce eight equally spaced square posts on the finger block.

Next, the finger blocks are cut selectively between the fingers to form machining blocks. For example, the finger block may be separated or divided equally into two four fingered blocks. Other divisions may be made as long as the machining blocks have at least two fingers.

Blocks of the same division or size are then placed on a machining center pallet. The machining center may, for example, have a horizontal spindle with an automatic tool changer. The pallet grips and positions the work with respect to the spindle. The pallet may move vertically and horizontally and rotate about a vertical axis. Typically, the machining center includes at least two pallets with one being unloaded and reloaded with blocks, while the computer controlled machining operations proceed on the blocks on the other.

The machining center uses a hollow mill to form the generally square fingers into round posts, and the hollow mill as well as the configuration and spacing of the fingers is such that no external cutting teeth need be employed, nor will any portion of the square finger remain after the hollow mill operation which might require removal with a secondary milling operation.

The interior of the posts is formed by drilling preferably eccentrically. One or more holes at right angles to the post are drilled and tapped. If the post is the flat pad type for compression connection of conductor lugs, the pads may be formed by cutting prior to placement in the machining center, or the machining center itself may machine the flats prior to the right angle drilling and tapping step. The machining center itself may include a deburring operation.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

FIG. 1 is a schematic illustration of an extrusion line in accordance with the present invention;

FIG. 2 is a fragmentary isometric of the extruded metal bar stock showing its fingered sectional configuration;

FIG. 3 is an illustration of the bar stock being cut to uniform width machining stock blocks;

FIG. 4 illustrates an eight fingered machining stock block formed by the transverse cut of FIG. 3;

FIG. 5 illustrates the cutting again of the stock blocks to form blocks with a desired set of fingers;

FIG. 6 illustrates the blocks loaded into a pallet of a machining center;

FIG. 7 illustrates a hollow mill forming the fingers into circular posts;

FIG. 8 illustrates the stock blocks being indexed through the machining center;

DETAILED DESCRIPTION OF THE PREFERRED EMBODIMENTS

Figure 9:
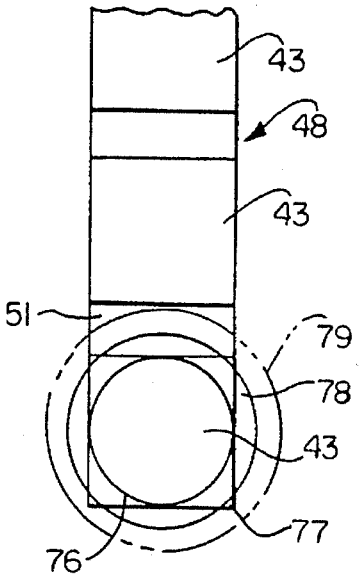
FIG. 9 is a schematic illustration showing the sweep of the hollow mill.

Referring now to the drawings and initially to FIG. 1, there is illustrated an extrusion line shown generally at 20. The extrusion line at the left hand end as shown includes a high pressure ram 21, being urged in the direction of the arrow 22, and moving within liner 23 of container body 24. The ram is pressing against a hot or heated billet or bloom 26, extruding the billet through die 27, held in place by die backer 28.

The extrusion process forms the hot billet or bloom into elongated electrically conductive metallic extruded stock shown generally at 30. The extruded stock passes through a cooler 31 and is supported on rollers or other suitable conveyors indicated at 32, to pass through a cutoff 33. The cutoff 33 is operable in response to the length of the extruded stock passing through the cutoff and may be actuated by a linear measure or flag positioned at the cutoff end 34, to cut the extruded stock into bar stock lengths. The lengths of the bar stock may be determined as a convenience for storage and shipment. Generally, lengths of sixteen (16) feet or more may readily be accommodated for shipment in bundles.

The metal of the bloom 26 and the extruded stock is a conductive metal and preferably an aluminum alloy.

The extruded stock 30 as seen in FIG. 2 is generally rectangular in configuration and includes spaced slots indicated at 36, along one long side which forms projections 37. The slots 36 extend almost but not quite to the opposite long side 38. In the illustrated embodiment of FIG. 2, there are seven slots 36 and eight projections 37. The projections and slots extend parallel to the extrusion axis.

The stock is bundled and transported to a machine shop where it is then transversely cut as seen in FIG. 3. The transverse cuts are shown at 40 and they are all parallel to each other and perpendicular to the extrusion axis.

After cutting as illustrated in FIG. 3, the stock then forms eight fingered machining blocks as seen at 42 in FIG. 4. The fingers thus formed as shown at 43 are now substantially square in transverse section, and the slots formed in the extrusion process now form the space 44 between each finger. The opposite side 38 of the extrudate now forms a bar 45 which connects all of the fingers at each base. If an eight conductor connector is desired, the machining block of FIG. 4 would then be subject to further machining to produce an eight conductor connector.

However, many connectors require only three or perhaps four connections and accordingly, the machining block stock 42 of FIG. 4 may be cut parallel to the extrusion axis as indicated at 46 in FIG. 5 to form two four finger machining stock blocks indicated at 47 and 48. Each block has four square posts equally spaced projecting from a bar which integrally joins the projecting posts, both structurally and electrically. The bar for the block 47 is shown at 50 while the bar for the block 48 is shown at 51. Such bars are simply the bar 45 cut in two at 46.

Referring now to FIG. 6, after the machining blocks are formed as seen in FIGS. 1–5, they are now loaded in a special machining center pallet shown generally at 60. The pallet includes vertically extending clamps 61 which grip the blocks 48 so that the fingers 43 face radially outwardly. As indicated, each pallet may accommodate four blocks, quadrant spaced, with the fingers extending radially and horizontally. The pallet includes a shuttle table 64 and the entire pallet in the machining center is mounted for indexing movement in the X, Y or Z direction, and also for rotation about the vertical or Z axis. The spindle of the machining center is rotating normal to the plane of FIG. 6 and the machining center is preferably of the fixed column type where the spindle may move vertically on a fixed column and the pallet moves only in the X and Y direction, or rotates about the Z axis. The machining center includes an automatic tool changer and is of the type where the pallet has at least two stations, one in proper orientation with respect to the spindle, and the other in position for loading or unloading. Such machining centers are available from Cincinnati Millicron, Inc. of Cincinnati, Ohio, for example.

When four blocks have been loaded on the special pallet as seen in FIG. 6, a computer program for the number of posts involved and the type of connector is then selected.

Referring now to FIGS. 6, 7 and 8, it will be seen that in the machining station of the machining center, the pallet will index the stock blocks 90° to the center position facing the viewer as indicated at 66. The first operation may be performed with a special hollow mill such as seen at 68 in FIG. 7. The hollow mill includes a cylindrical body 69, having relatively fine cutting teeth 70 on the axial end and projecting slightly from the interior of the body. As hereinafter described, depending upon the diameter of the mill, and the spacing between the square projections 43, teeth on the exterior of the mill body are not required.

The body at the shank includes an axial port 72 whereby coolant under pressure enters the interior of the mill seen at 73. The coolant flowing in the direction of the arrow 74 enters the interior of the mill body and under pressure flushes chips away from the cutting teeth 70 to the exterior of the mill body. The mill is mounted for high speed rotation on the machining center spindle and quickly forms the exterior of the square projection 43 into a round post 76.

As seen in FIG. 9, the diameter of the cutting teeth on the end of the hollow mill is selected to remove corners indicated at 77 thereby avoiding a secondary milling operation. If the mill were of the diameter indicated at 78, such corners could be left. Accordingly, the mill cutting teeth should have a diameter which can range up to that shown at 79 to ensure that the corners are removed during the hollow mill operation. The teeth of the hollow mill are selected to impart the fine surface finish to the portion of the bar or bus 51 facing the viewer in FIG. 9. With the hollow mill indicated which will mill away the corners 77, the round post 76 is produced in one pass.

It is noted from FIG. 9 that the exterior circular surface 76 is tangent to all four sides of the square projection 43 so that minimal metal is removed, and the circular post 76 has a diameter equal to the width of the bar 51 which will connect such posts.

After the posts are formed, the pallet 60 is indexed a very short distance horizontally and blind holes 80 are then drilled in each circular post 76 as seen in FIG. 8. The eccentric blind holes form a barrel wall which has a thickest portion on the left hand side of the center station of FIG. 8 as indicated at 81. The blind holes are drilled substantially to the projection of the posts. Either concurrently with the hollow mill or blind hole drilling, or as a separate operation, the relatively sharp outer corner of the post indicated at 82 may be chamfered.

Next, the pallet is pivoted about the Z axis to present the thicker wall portion 81 toward the viewer as seen in FIG. 8 on the right hand side of the pallet. The pallet is again indexed with respect to the spindle and the machining center then drills and taps set screw holes 83. After deburring, the parts are removed from the pallet, and after cleaning and assembly, are ready for use.

Figure 10:
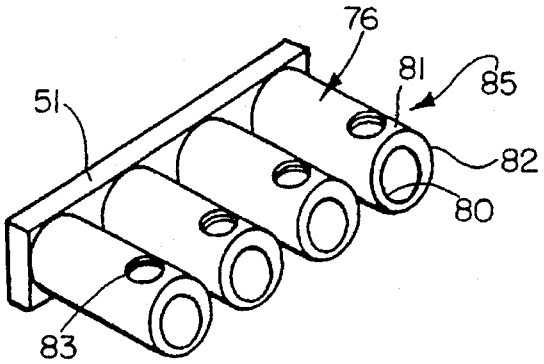
FIG. 10 is an isometric view of a typical hollow post connector made with the invention.

Referring now to FIG. 10, there is illustrated a finished electrical connector shown generally at 85 which includes the bar 51 interconnecting the hollow posts 76. Each post includes an eccentric conductor receiving blind hole 80, and in the largest wall thickness area 81, there is provided a threaded hole 83 for a set screw. In operation, the end of the conductor is inserted into the blind hole and clamped in place by the set screw. The axial length of the circular post 76 may be approximately ten times the thickness of the bar and such projection ratio may vary anywhere from about 4 to 1 to about 12 to 1, for example.

Figure 12:
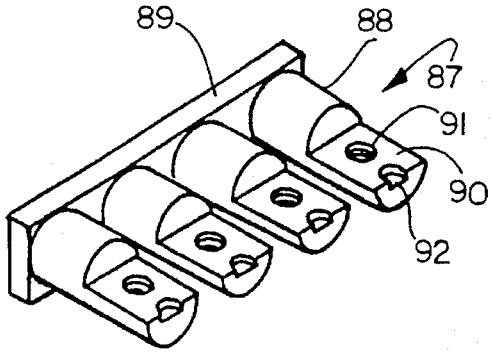
FIG. 12 is an isometric view of a typical flat pad electrical connector made by the process.

Another type of connector 87 which may be made in accordance with the present invention is shown in FIG. 12. This conductor has circular post 88 projecting from the connecting bus or bar 89. The illustrated connector has four side-by-side posts, but it will be appreciated that the number of posts may vary and with the extrusion 30, up to eight posts may be formed projecting from a common bar. The connector 87 is a flat pad compression connector and each post includes a flat axially extending surface 90 which may extend for approximately the outer two thirds of the post. The post in the flat includes a tapped hole 91 and an outer indentation 92. The tapped hole enables a conductor lug to be clamped in compression against the flat pad surface with a projection on the lug interfitting with the indentation 92 to keep the lug in alignment with the post.

Figure 11:
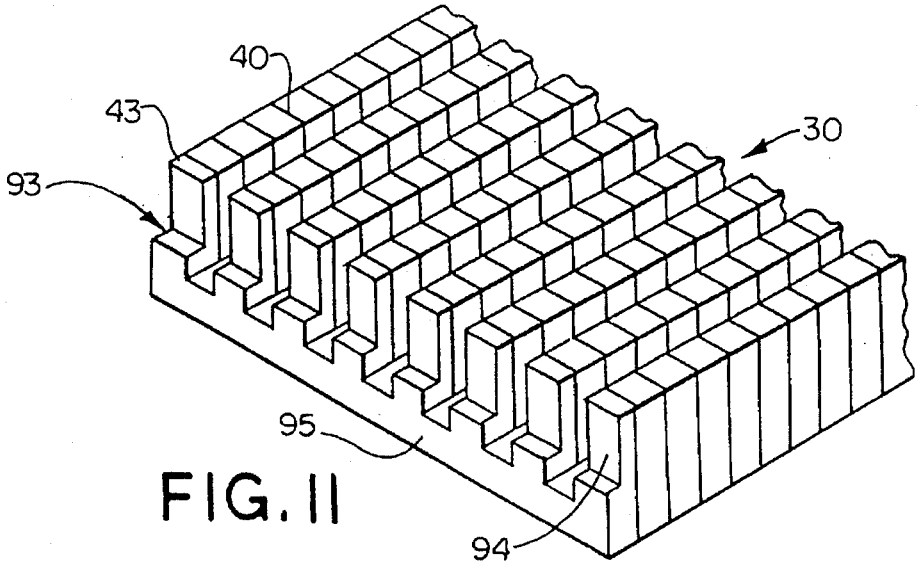
FIG. 11 is a view like FIG. 3 but illustrating the cutting of a flat in the fingers to make with the same machining method a flat pad pressure connector.

The connector 87 of FIG. 12 is made in the same manner as described above for the hollow post connector. FIG. 11 illustrates the extrudate after having been transversely cut such as seen in FIG. 3. To form the connector 87, the extrudate is transversely cut again to form the L-shape cutout shown generally at 93 in each projection 43. The L-shape cutout provides an axial surface seen at 94 which becomes the flat pad 90 of the connector 87. The surface 94 is slightly offset from the center of the otherwise square projection 43 so that the flat pad surface 90 is slightly smaller in width than the diameter of the post 88. When cut in the manner indicated in FIG. 11, the now L-shape square projections are interconnected by the continuous bar 95. The bar may be cut between two posts to provide smaller stock blocks such as the four projection blocks illustrated in FIG. 5. The stock blocks are loaded onto the machining center pallet in the same manner, and the hollow mill will form the rounded posts from the L-shape projections. The drilling of the posts axially is omitted and the pallet is indexed 90° and repositioned with respect to the spindle in order to drill and tap the holes 91 as well as form the indentations 92.

With both connectors illustrated, the pallet holds the blocks so that the fingers or posts axially face the viewer or spindle in the center position seen in FIGS. 6 and 8, to form the posts, and transaxially of the spindle as seen by the right hand side of such Figures, to drill and tap the fastener holes.

As seen in applicant's copending applications filed even date herewith, the connectors of the type seen in FIGS. 10 and 12 may be provided with two set screw holes along the conductor receiving barrel or two clamp fastener holes 91 in the flat pad surface. It will accordingly be appreciated that a wide variety of similar connectors may be manufactured in the same manner.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A method of making an electrical connector comprising the steps of:

extruding a rectangular-in-section conductive metallic extrudate having spaced slots along one long side extending almost to the opposite long side to form projections extending from said opposite long side;

transversely cutting the extrudate to form a rectangular stock finger block of conductive metal so that said slots form substantially square posts projecting from the unslotted opposite long side of the finger block;

placing a number of said blocks on a machining center pallet;

machining said blocks to form said square posts into round posts; and forming and tapping a transverse screw hole in each post to facilitate the clamping of a conductor to said respective posts.

2. A method as set forth in claim 1 including the step of drilling an axial hole in each post, and drilling and tapping the screw holes into the axial hole.

3. A method as set forth in claim 2 including drilling said axial hole offset from the axis of the post to form a barrel wall having a thicker portion on one side, and drilling and tapping at least one screw hole in said thicker portion.

4. A method as set forth in claim 1 including the step of forming the round posts with a hollow mill having cutting teeth on the interior and axial end.

5. A method as set forth in claim 4 wherein the circular surface of the round posts formed is substantially tangent to all four sides of said substantially square posts.

6. A method as set forth in claim 1 wherein said round posts formed have a diameter substantially equal to the width of the transverse cut.

7. A method as set forth in claim 1 including the step of cutting the finger block selectively between fingers to form a machining block having a desired lesser number of fingers.

8. A method as set forth in claim 1 including the step of transversely cutting the finger block to create an axially extending flat pad surface on each finger.

9. A method as set forth in claim 8 including the step of drilling and tapping at least one fastener hole in each flat pad surface.

10. A method as set forth in claim 9 including the step of forming an indentation in the axial end of each flat pad surface.

11. A method as set forth in claim 1 including the step of loading a plurality of said finger blocks on a machining center pallet for indexing with respect to the spindle of a machining center.

12. A method as set forth in claim 11 wherein said blocks are supported by the pallet so that the fingers axially face the spindle in one position, and are transaxial to the spindle in another position.

13. A method as set forth in claim 11 including the step of forming said substantially square posts into circular posts with a hollow mill.

14. A method as set forth in claim 13 wherein said hollow mill has a center flush of coolant to sweep chips away from the surface being formed.

15. A method as set forth in claim 14 wherein said hollow mill has a working diameter sufficient to remove all four corners of said substantially square posts.

* * * * *